US009791826B2

(12) United States Patent
Nishino

(10) Patent No.: US 9,791,826 B2
(45) Date of Patent: Oct. 17, 2017

(54) DEVELOPING APPARATUS HAVING A FRAME PORTION WITH VARIED THICKNESS, AND PROCESS CARTRIDGE THEREOF

(71) Applicant: CANON KABUSHIKI KAISHA, Tokyo (JP)

(72) Inventor: Kosuke Nishino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/325,825

(22) Filed: Jul. 8, 2014

(65) Prior Publication Data

US 2015/0016838 A1 Jan. 15, 2015

(30) Foreign Application Priority Data

Jul. 12, 2013 (JP) ..... 2013-146303

(51) Int. Cl.
*G03G 21/18* (2006.01)

(52) U.S. Cl.
CPC ..... *G03G 21/181* (2013.01); *G03G 21/1821* (2013.01)

(58) Field of Classification Search
CPC ..... G03G 15/0832; G03G 21/1814; G03G 21/181; G03G 21/1821
USPC ..... 399/111, 114
See application file for complete search history.

(56) References Cited

U.S. PATENT DOCUMENTS

2015/0016829 A1* 1/2015 Watanabe et al. ..... 399/27

FOREIGN PATENT DOCUMENTS

JP 2003-248371 A 9/2003

* cited by examiner

*Primary Examiner* — Walter L Lindsay, Jr.
*Assistant Examiner* — Philip Marcus T Fadul
(74) *Attorney, Agent, or Firm* — Canon U.S.A. Inc., IP Division

(57) ABSTRACT

A process cartridge including a first frame member molded by pouring a resin from a gate; a conductive sheet adhered integrally to a sheet adhering portion of the first frame member by molding of the resin; and a second frame member configured to define a toner storage portion by being coupled with the first frame member, wherein, the first frame member includes a bent portion at the sheet adhering portion, and a portion of the first frame member different in thickness is provided at an adjacent position to the adhering portion.

11 Claims, 15 Drawing Sheets

DEVELOPING APPARATUS HAVING A FRAME PORTION WITH VARIED THICKNESS, AND PROCESS CARTRIDGE THEREOF

BACKGROUND OF THE INVENTION

Field of the Invention

The present invention relates to a developing apparatus, a developing cartridge, a process cartridge, and a method of manufacturing molded articles.

The developing apparatus is apparatus including a developing roller, and configured to visualize an electrostatic latent image formed on an electrophotographic photosensitive drum by using developer (hereinafter, referred to as toner) with the developing roller.

The developing cartridge is formed by integrating the developing apparatus into a cartridge, and is demountably mounted on a main body of an electrophotographic image forming apparatus. The process cartridge includes the electrophotographic photosensitive drum and the developing apparatus configured to act on the electrophotographic photosensitive drum integrated into the cartridge and is configured to be demountably mounted on the main body of the electrophotographic image forming apparatus.

Description of the Related Art

An electrophotographic image forming apparatus using an electrophotography forming process of the related art employs a process cartridge system including an electrophotographic photoreceptor and a process device acting thereon integrated into a cartridge so as to allow the cartridge to be demountably mountable on a main body of the electrophotographic image forming apparatus.

According to the process cartridge system, maintenance of the apparatus can be performed by users themselves without resort to a serviceman, and hence operability is significantly improved. Therefore, the process cartridge system is widely used in the electrophotographic image forming apparatus.

In the case of the electrophotographic image forming apparatus employing the process cartridge system, the process cartridge is replaced by the users as described above. Therefore, an amount-of-remaining-toner sensing device configured to sense consumption of toner, and notify time for replacement to the users is often provided.

Examples of the amount-of-remaining-toner sensing device include a system that senses a change in electrostatic capacitance between a plurality of electrodes arranged in the process cartridge and senses an amount of remaining toner. As an example of the system as described above, Japanese Patent Laid-Open No. 2003-248371 proposes a configuration in which a developer bearing member is used as an input-side electrode by applying an AC bias thereto, and an electrostatic capacitance sensing member serving as an output-side electrode is provided at a position opposing the developer bearing member in the developing apparatus. In this configuration, a contact member configured to electrically connect the electrostatic capacitance sensing member and a conductive member having a spring property provided in the main body of the image forming apparatus (hereinafter, referred to as a main body-side amount-of-remaining-toner contact) is provided on the process cartridge. When the AC bias is applied to the developer bearing member, an electric current depending on the electrostatic capacitance (the amount of remaining toner) is induced between the developer bearing member and the electrostatic capacitance sensing member. The amount of remaining toner can be sensed successively by measuring a current value of an induced current with an amount-of-remaining-toner sensing unit in the main body of the image forming apparatus via the contact member provided on the process cartridge side and the main body-side amount-of-remaining-toner contact.

In the method of the related art, highly precise arrangement of many components such as keeping a distance between a member for sensing the electrostatic capacitance and the developer bearing member constant is required for sensing the amount of developer accurately in high degree of precision.

SUMMARY OF THE INVENTION

This disclosure realizes space saving and high reliability of sensing of an amount of remaining toner by achieving an electrical connection between a member configured to sense an electrostatic capacitance provided on a process cartridge and a main body-side amount-of-remaining-toner contact in a simple configuration.

This disclosure provides a developing apparatus including: a first frame member molded by pouring a resin from a gate; a conductive sheet adhered integrally to a sheet adhering portion of the first frame member by molding of the resin; and a second frame member configured to define a toner storage portion by being coupled with the first frame member, wherein the first frame member includes: a bent portion at the sheet adhering portion, and a portion having a different thickness provided at an adjacent portion to the adhering portion.

This disclosure also provides a process cartridge including: a first frame member molded by pouring a resin from a gate; a conductive sheet adhered integrally to a sheet adhering portion of the first frame member by molding of the resin; and a second frame member configured to define a toner storage portion by being coupled with the first frame member, wherein the first frame member includes: a bent portion at the sheet adhering portion, and a portion having a different thickness provided at an adjacent portion to the adhering portion.

This disclosure also provides a method of manufacturing a molded article including: inserting a conductive sheet between a first molding and a second molding; forming a cavity by mating the first molding and the second molding; and pouring a resin from a gate and molding with the conductive sheet integrally adhered thereto, wherein the first molding or the second molding includes a shape configured to differentiate a distance of the cavity formed at an adjacent portion to a portion where the conductive sheet is inserted, and the shape changes a flow of the resin to restrain extension of the conductive sheet.

Further features of the present invention will become apparent from the following description of exemplary embodiments with reference to the attached drawings.

DESCRIPTION OF THE EMBODIMENTS

An embodiment of this disclosure will be described below with reference to the drawings in detail.

A direction of an axis of rotation of an electrophotographic photosensitive drum is defined as a longitudinal direction.

In the longitudinal direction, a side where the electrophotographic photosensitive drum receives a driving force from the main body of the image forming apparatus is defined as a driven side, and a side opposite thereto is defined as a non-driven side.

A general configuration and an image forming process will be described with reference to FIG. 3 and FIG. 4.

Figure 3:
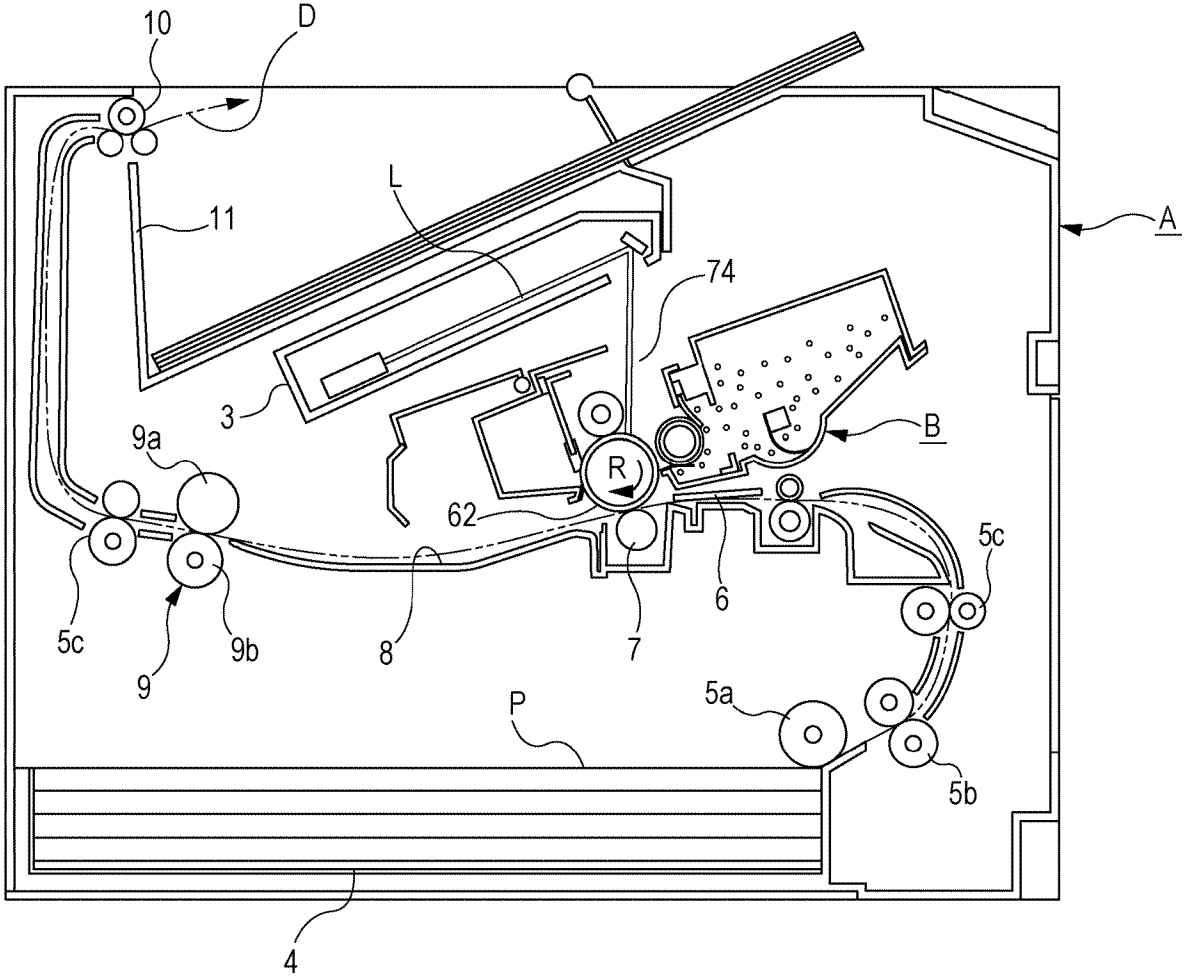
FIG. 3 is a cross-sectional view of a main body of an image forming apparatus and a process cartridge of an electrophotographic image forming apparatus according to the embodiment.

FIG. 3 of the embodiment of this disclosure is a cross-sectional view of the main body of the image forming apparatus (hereinafter, referred to as an apparatus main body A) of the electrophotographic image forming apparatus and a process cartridge (hereinafter referred to as a cartridge B).

Figure 4:
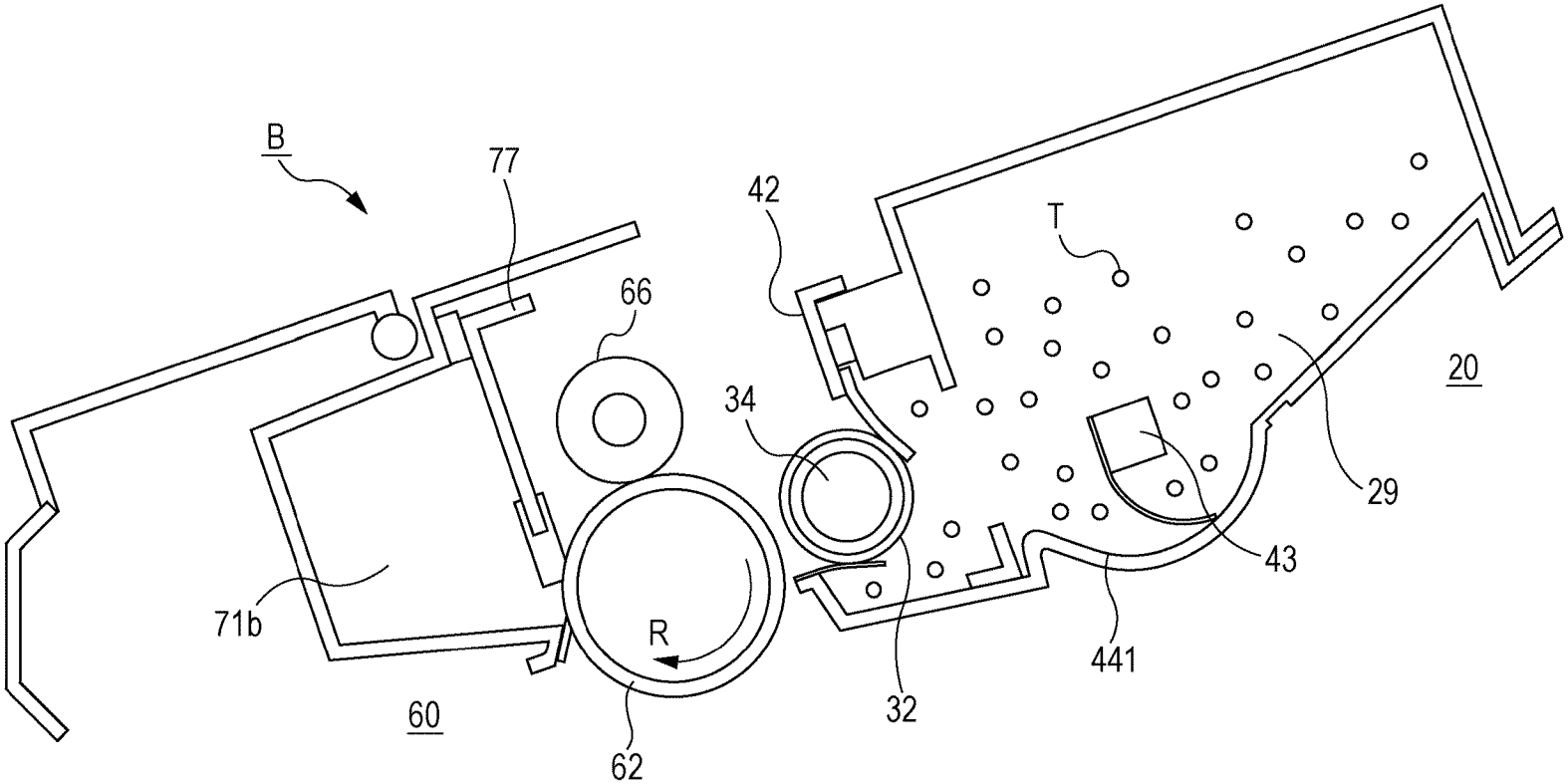
FIG. 4 is a cross-sectional view of the process cartridge according to the embodiment.

FIG. 4 is a cross-sectional view of the cartridge B.

Here, the apparatus main body A of the electrophotographic image forming apparatus is a portion of the electrophotographic image forming apparatus from which the cartridge B is removed.

General Configuration of Electrophotographic Image Forming Apparatus

In FIG. 3, the electrophotographic image forming apparatus is a laser beam printer using an electrophotographic technology in which the cartridge B is demountably mounted on the apparatus main body A. When the cartridge B is mounted on the apparatus main body A, an exposure unit 3 (laser scanner unit) is arranged in an upper side of the cartridge B.

Also, a sheet tray 4 in which a recording medium (hereinafter, referred to as a sheet material P) which is a target of image formation is stored is arranged on a lower side of the cartridge B.

In addition, the apparatus main body A includes a pickup roller 5*a*, a feed roller pair 5*b*, a conveyance roller pair 5*c*, a transfer guide 6, a transfer roller 7, a transfer guide 8, a fixing unit 9, a discharge roller pair 10, and a discharge tray 11 arranged in sequence along a direction of conveyance D of the sheet material P. The fixing unit 9 includes a heat roller 9*a* and a pressurizing roller 9*b*.

Image Formation Process

Subsequently, the image forming process is described schematically. On the basis of a print start signal, the electrophotographic photosensitive drum (hereinafter, referred to as a drum 62) is driven to rotate at a predetermined circumferential velocity (process speed) in a direction indicated by an arrow R.

A charging roller 66 to which a bias voltage is applied, comes into contact with an outer peripheral surface of the drum 62, and charges an outer peripheral surface of the drum 62 uniformly and evenly.

The exposure unit 3 outputs a laser beam L in accordance with image information. The laser beam L passes through an exposure window portion 74 on an upper surface of the cartridge B, and scans and exposes the outer peripheral surface of the drum 62.

Accordingly, an electrostatic latent image corresponding to the image information is formed on the outer peripheral surface of the drum 62.

In contrast, as illustrated in FIG. 3 in a developing device unit 20 as the developing apparatus, toner T in a toner storage portion 29 is stirred and conveyed by a rotation of a conveyance member 43.

The toner T is born on a surface of a developing roller 32 by a magnetic force of a magnet roller 34 (fixed magnet).

The toner T is controlled in layer thickness on the peripheral surface of the developing roller 32 while being charged by friction by a developing blade 42.

The toner T is transferred to the drum 62 in accordance with the electrostatic latent image, and is visualized as a toner image.

As illustrated in FIG. 3, the sheet material P stored in a lower portion of the apparatus main body A is fed from the sheet tray 4 by the pickup roller 5*a*, the feed roller pair 5*b*, and the conveyance roller pair 5*c* at the same timing as outputting of the laser beam L.

Then, the sheet material P passes through the transfer guide 6, and is fed to a transfer position between the drum 62 and the transfer roller 7. At this transfer position, toner images are transferred in sequence from the drum 62 to the sheet material P.

The sheet material P to which the toner image is transferred is separated from the drum 62 and conveyed to the fixing unit 9 along the transfer guide 8. The sheet material P then passes through a nip portion between the heat roller 9*a* and the pressurizing roller 9*b* which constitute the fixing unit 9.

At the nip portion, pressurization and heat-fixation is performed, so that the toner image is fixed to the sheet material P. The sheet material P subjected to the fixation of the toner image is conveyed to the discharge roller pair 10, and is discharged to the discharge tray 11.

In contrast, as illustrated in FIG. 4, residual toner on the outer peripheral surface of the drum 62 after the transfer is removed by a cleaning blade 77, and the drum 62 is used for the image forming process again. The toner removed from the drum 62 is stored in a waste toner chamber 71*b* of a cleaning unit 60.

In the above-described description, the charging roller 66, the developing roller 32, and the cleaning blade 77 are process devices acting on the drum 62.

Configuration of Mounting and Demounting of Cartridge

Subsequently, mounting and demounting of the cartridge B with respect to the apparatus main body A will be described with reference to FIG. 5.

Figure 5:
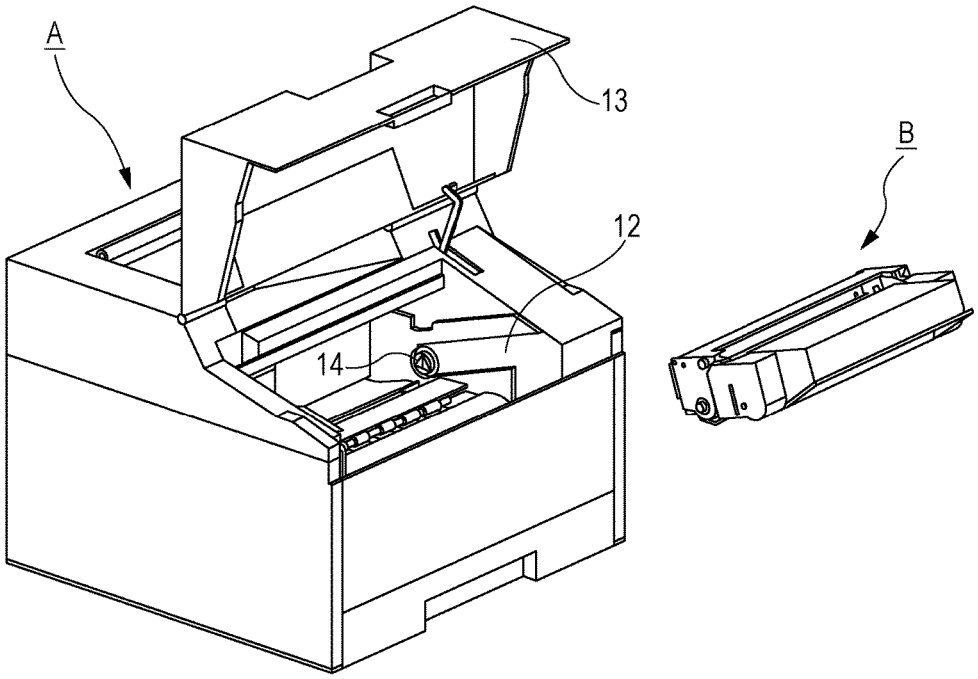
FIG. 5 is a perspective view of the main body of the image forming apparatus and the process cartridge according to the embodiment in a state in which an opening and closing door is opened.

FIG. 5 is a perspective view of the apparatus main body A in a state in which an opening and closing door 13 is opened for mounting and demounting the cartridge B and the cartridge B.

The opening and closing door 13 is rotatably mounted on the apparatus main body A. When the opening and closing door 13 is opened, a guide rail 12 is provided, and the cartridge B is mounted in the apparatus main body A along the guide rail 12.

Subsequently, a drive shaft 14 driven by a motor (not illustrated) of the apparatus main body A engages a driving force receiving portion provided on the cartridge B.

Accordingly, the drum 62 coupled to the driving force receiving portion receives a driving force from the apparatus main body A and rotates.

General Configuration of Cartridge

Subsequently, a general configuration of the cartridge B will be described with reference to FIG. 4 and FIG. 6.

Figure 6:
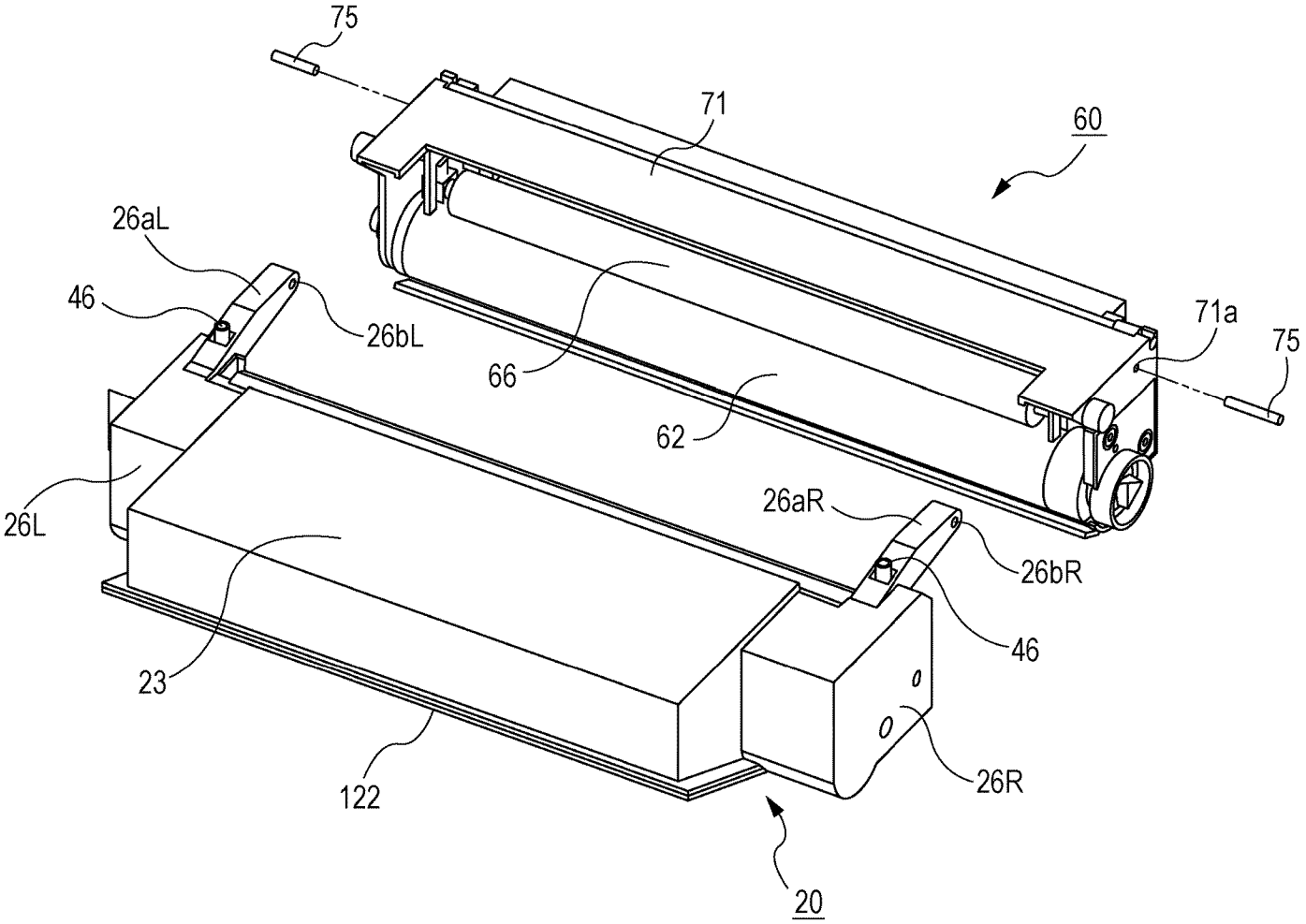
FIG. 6 is an explanatory perspective view illustrating a configuration of the process cartridge according to the embodiment.

FIG. 6 is an explanatory perspective view illustrating a configuration of the cartridge B.

The cartridge B includes the cleaning unit 60 and the developing device unit 20 combined with each other.

The cleaning unit 60 includes a cleaning frame member 71, the drum 62, the charging roller 66, and the cleaning blade 77.

In contrast, the developing device unit 20 includes a lid member 122, a toner storage container 23, a first side member 26L, a second side member 26R, the developing blade 42, the developing roller 32, the magnet roller 34, the conveyance member 43, the toner T and biasing members 46.

The cartridge B is formed by coupling the cleaning unit 60 and the developing device unit 20 with a coupling member 75 so as to be rotatable with each other.

Specifically, rotation holes 26*b*L and 26*b*R, extending in parallel with the developing roller 32, are formed at distal ends of arm portions 26*a*L and 26*a*R formed on the first side member 26L and the second side member 26R provided on the developing device unit 20 at both ends thereof in the longitudinal direction.

Fitting holes 71*a* for fitting coupling members 75 are formed at both ends of the cleaning frame member 71 in the longitudinal direction.

The cleaning unit 60 and the developing device unit 20 are coupled so as to be capable of rotating about the coupling members 75 by aligning the arm portions 26*a*L and 26*a*R to predetermined positions of the cleaning frame member 71 and inserting the coupling members 75 into the rotation holes 26*b*L and 26*b*R and the fitting holes 71*a*.

At this time, the biasing members 46 mounted at roots of the arm portions 26*a*L and 26*a*R abut against the cleaning frame member 71, thereby biasing the developing device unit 20 toward the cleaning unit 60 about the coupling members 75 as a center of rotation.

Accordingly, the developing roller 32 is reliably pressed in the direction of the drum 62.

Developing Device Unit

Figure 7:
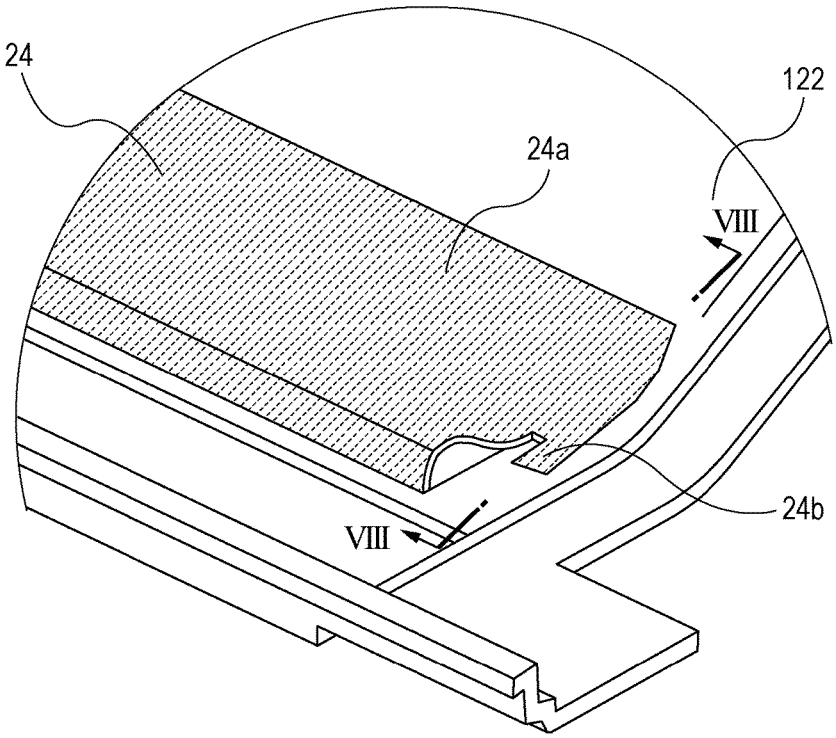
FIG. 7 is a partial perspective view of the first frame member molded with a conductive sheet of the embodiment adhered thereto.

Subsequently, a configuration of the developing device unit 20 of this disclosure will be described with reference to FIG. 2, FIG. 7, and FIG. 8. FIG. 7 illustrates a partial perspective view of a member formed by adhering a conductive sheet 24, which corresponds to an amount-of-remaining-toner sensing member, to a sheet adhering portion 446 of the lid member 122, which corresponds to a first frame member illustrated in FIG. 2.

When molding the first frame member, the conductive sheet 24 is preferably molded by inserting the conductive sheet 24 into the mold in advance so that the conductive sheet is molded in a state of being adhered to (being molded integrally with) a molded article at the time of molding of the first frame member.

As illustrated in FIG. 7, the conductive sheet 24 is functionally divided into two parts, namely, a toner remaining amount sensing unit 24*a* and a contact portion 24*b*, and the entire part of the conductive sheet 24 is adhered to the first frame member (lid member) 122.

The conductive sheet 24 may be a conductive sheet having a three-layer structure including a PS resin sandwiched between conductive layers of PS resin mixed with carbon black, or may be a conductive sheet having a single-layer structure formed of an EVA resin mixed with carbon black. The conductive sheet 24 may also be a conductive sheet having a two-layer structure formed of PS resin printed with carbon black. The entire thickness of the conductive sheet 24 preferably falls within a range from 0.05 mm to 0.3 mm. The conductive sheet 24 is not limited to those described above, and any conductive sheet may be used as long as it follows the molding by the application of resin pressure, and is fixed to the first frame member (lid member) 122 at least with a certain level of strength after molding.

Figure 8:
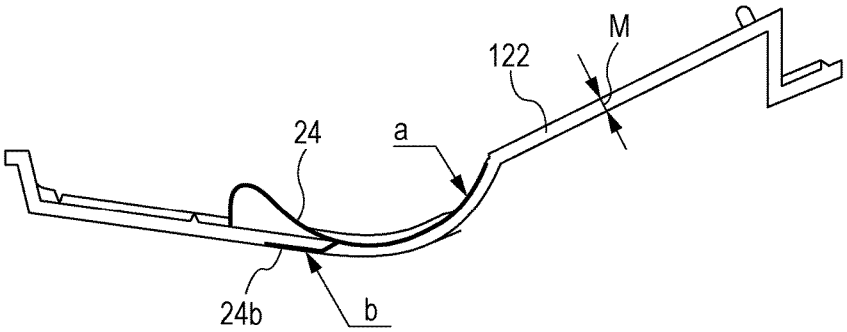
FIG. 8 is a cross-sectional view of FIG. 7.

FIG. 8 is a cross-sectional view taken along the line VIII-VIII in FIG. 7. As illustrated in the drawing, the contact portion 24*b* of the conductive sheet 24 is molded so that the conductive sheet 24 is exposed to a surface b, which is a surface opposite to a surface a on the side where the conductive sheet 24 comes into contact with the toner of the first frame member (lid member) 122.

A portion where the conductive sheet 24 is adhered to includes a bent portion 44 at an arcuate angle between a R-shape 441 for allowing the rotation of a toner stirring conveyance member 43 (see FIG. 4) and an upright wall 442.

Most part of the first frame member (lid member) 122 is formed at a uniform thickness (M). The uniform thickness (M) is referred to as a basic thickness here. The basic thickness preferably falls within a range from 1.0 mm to 3.0 mm.

Subsequently, an amount-of-remaining-toner sensing system will be described with reference to FIGS. 1, 8, 9, and 10.

Figure 9:
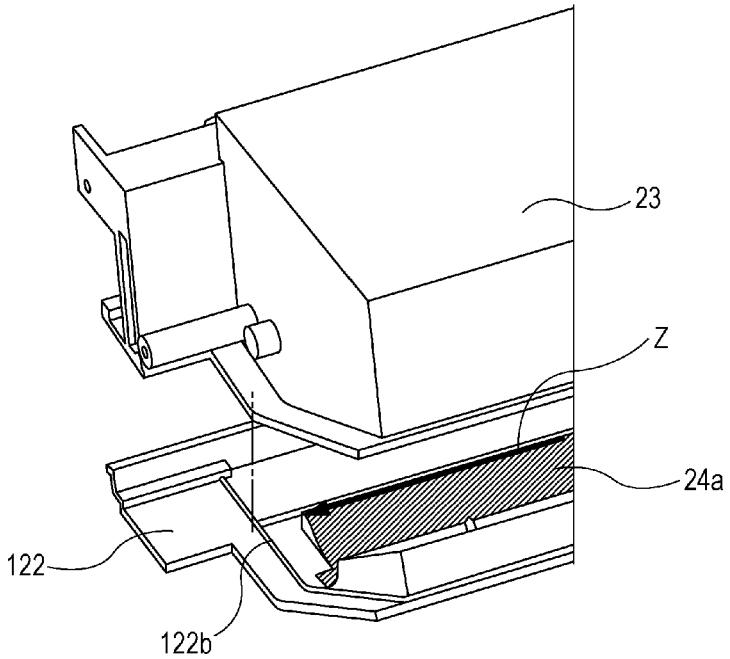
FIG. 9 is an explanatory partial perspective view for explaining coupling between the first frame member molded with the conductive sheet adhered thereto and a toner storage frame member according to the embodiment.

As described above, the first frame member (lid member) 122 adhered to the conductive sheet 24 is fixed by means such as welding to the toner storage container 23, which corresponds to a second frame member, as illustrated in FIG. 9. In this embodiment, a welding rib 122*b* is provided on the first frame member (lid member) 122, and ultrasonic vibrations are applied to the second frame member (toner storage container) 23, so that the first frame member (lid member) 122 and the second frame member (toner storage container) 23 are coupled.

Figure 10:
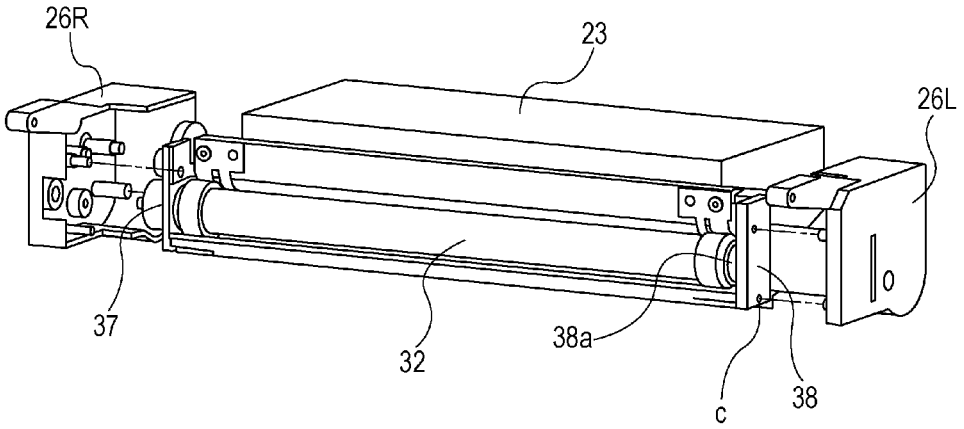
FIG. 10 is a perspective view of the developing apparatus to which this disclosure is applicable.

The developing roller 32 having a conductivity arranged so as to oppose the conductive sheet 24 is supported by bearing members 37 and 38 as illustrated in FIG. 10, and is rotatably mounted on the toner storage container 23 via side members 26L and 26R.

In this embodiment, hollow aluminum is used for the developing roller 32 and conductive resin is used for a bearing member 38 on the non-driven side as materials, and an outer periphery 38*a* of the bearing member 38 supports an inner periphery of the non-driven side of the developing roller 32.

When the cartridge B is inserted into the apparatus main body A, a development contact spring, which is not illustrated, electrically connected to the circuit in the apparatus main body A comes into abutment with a lower surface c of the bearing member 38 (FIG. 10), whereby bias is applied to the developing roller 32.

The contact portion b of the conductive sheet 24 (see FIG. 8) is configured to come into abutment with the main body-side amount-of-remaining-toner contact (not illustrated) which is electrically connected to the amount-of-remaining-toner sensing unit of the apparatus main body A when the cartridge B is inserted into the apparatus main body A.

Figure 1:
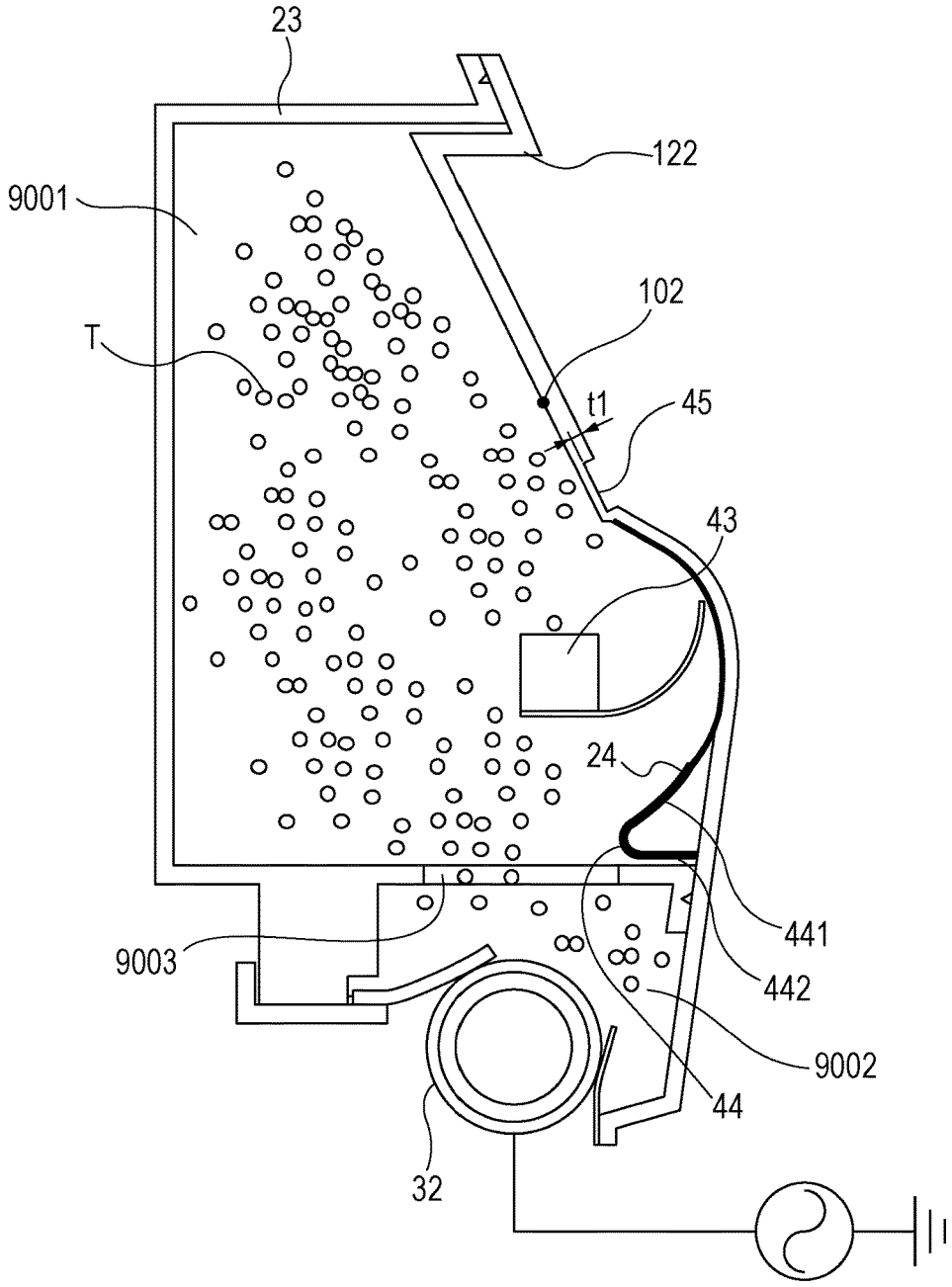
FIG. 1 is a cross-sectional view of a developing apparatus according to an embodiment.

FIG. 1 illustrates a cross-sectional view of the developing apparatus in a state in which the cartridge is inserted into the apparatus main body.

The cartridge includes a first chamber 9001 configured to store the toner therein, a second chamber 9002 in which the developing roller 32 is mounted, and an opening portion 9003 formed between the first chamber and the second chamber, and is configured in such a manner that the toner T is supplied from the first chamber 9001 through the opening portion 9003 to the second chamber 9002 to cause the toner T adhered to the developing roller 32.

The first chamber 9001 is defined by a frame member formed with the conductive sheet 24 adhered to a portion adjacent to the opening portion 9003.

The portion adjacent to the opening portion 9003 needs to be provided with the upright wall 442 so as to extend along a wall between the R-shape 441 for allowing the toner stirring conveyance member 43 to rotate and the second chamber 9002, and hence the bent portion 44 at an acute angle is included between the curved shape (R-shape) 441 and the upright wall 442.

Since the shape is abruptly varied from a highest portion of the acute angled bent portion, the amount of remaining toner may be measured effectively by adhering the conductive sheet 24 to the bent portion 44 between the curved surface shape (R-shape) 441 and the upright wall 442.

When molding the first frame member (lid member) 122, a thickness varied portion 45 is formed between a gate (or a trace of the gate (gate trace)) 102 for allowing the resin to flow into a space (cavity) having the shape of the first frame member and a portion to which the conductive sheet 24 is adhered. The gate trace for allowing the resin into the cavity for molding the first frame member (molded article) may remain on the first frame member (molded article). In this specification, the gate and the gate trace remaining on the molded article are collectively referred to as "gate".

When an AC voltage is applied to the developing roller 32, a current corresponding to the electrostatic capacitance between the developing roller 32 and the conductive sheet 24 is induced therebetween. The electrostatic capacitance changes in accordance with the amount of the toner T between the developing roller 32 and the conductive sheet 24. Therefore, by measuring the current value with the amount-of-remaining-toner sensing unit (not illustrated), the toner remaining amount T between the developing roller 32 and the conductive sheet 24 may be sensed successively.

Figure 2:
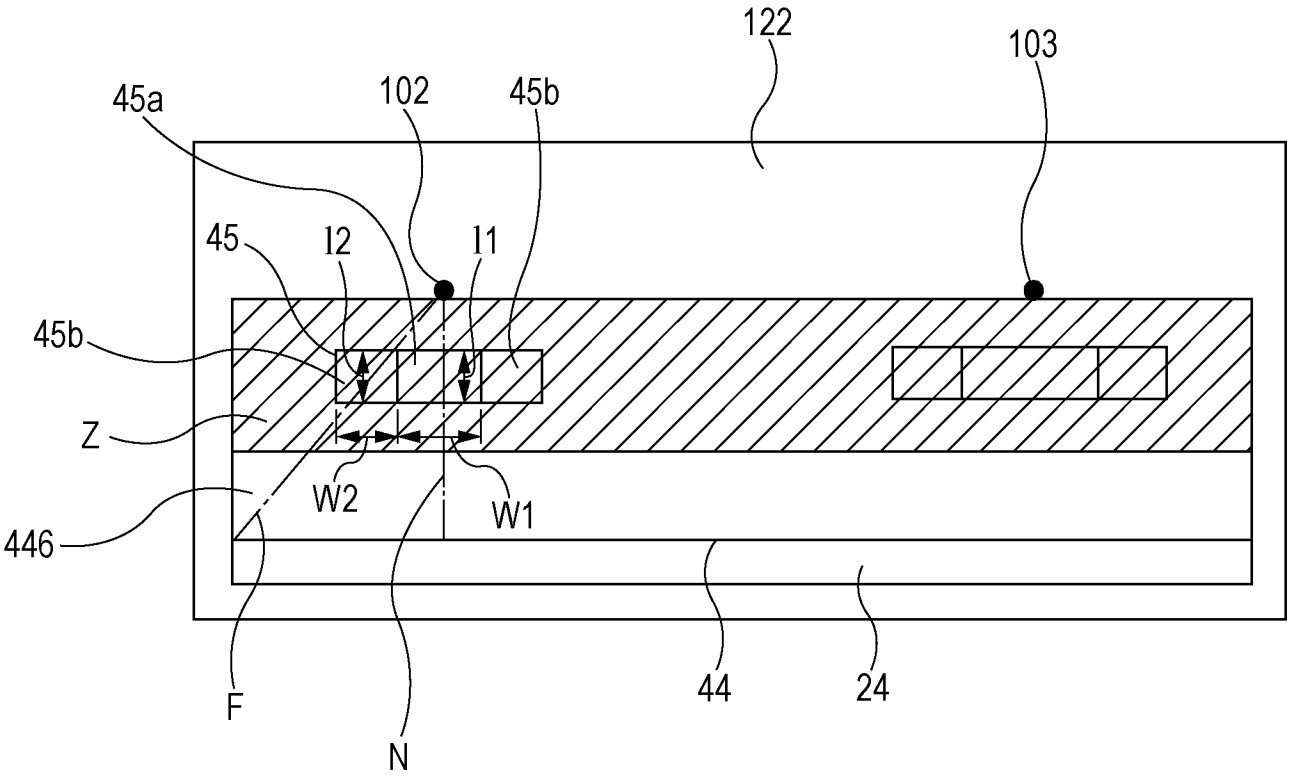
FIG. 2 is a partly enlarged view of a first frame member according to the embodiment.

Description about Thickness Varied Portion (Portion where the Thickness is Different FIG. 2 is a schematic drawing illustrating part of the first frame member (lid member) 122 in an enlarged scale. Reference numeral 446 denotes a sheet adhering portion to which the conductive sheet 24 is adhered. The thickness varied portion 45 is provided at an adjacent portion to the sheet adhering portion 446 (between the conductive sheet and gates 102 and 103). The thickness varied portion 45 corresponds to a portion where the thickness M of the first frame member (lid member) is different. The portion where the thickness M of the first frame member (lid member) is different is preferably a depression formed by reducing the thickness of the first frame member (lid member) 122. However, it may be a projecting portion projected by increasing the thickness of the first frame member (lid member) 122. The thickness varied portion 45 may be formed on the surface on a side coming into contact with the toner, or may be formed on a surface b on the back. However, the thickness varied portion 45 is preferably formed on the surface b on the back.

The adjacent portion to the sheet adhering portion 446 corresponds to an area Z ranging from the gates 102 and 103 for allowing the resin to flow into the space (cavity) having the shape of the first frame member when molding the first frame member (lid member) 122 to the sheet adhering portion.

The thickness varied portion preferably includes a portion 45*a* reduced in thickness from the thickness of the first frame member on a line N connecting the gate 102 and a bent portion closest to the gate 102. A depressed amount (amount of thickness variation) t1 of a portion having a reduced thickness preferably falls within a range from 0.2 mm to 0.5 mm. A width w1 is preferably at least 20 mm. A portion 45*b* having a larger thickness may be provided adjacently to the portion having a reduced thickness. The portion having a larger thickness is preferably on a line F connecting the bent portion at an end of the conductive sheet 24 and the gate 102 closest to the bent portion at the end of the conductive sheet 24. A width w2 of the portion 45*b* is preferably at least 30 mm.

Method of Manufacturing Molded Article (First Frame Member (Lid Member))

Subsequently, a method of manufacturing the molded article (first frame member (lid member)) 122 will be described. The first frame member (lid member) 122 is molded by inserting the conductive sheet in a cavity in the molding in advance, then pouring resin into the cavity. Accordingly, the first frame member (lid member) 122 provided with the conductive sheet adhered thereto (adhered integrally thereto) is manufactured.

Figure 11A:
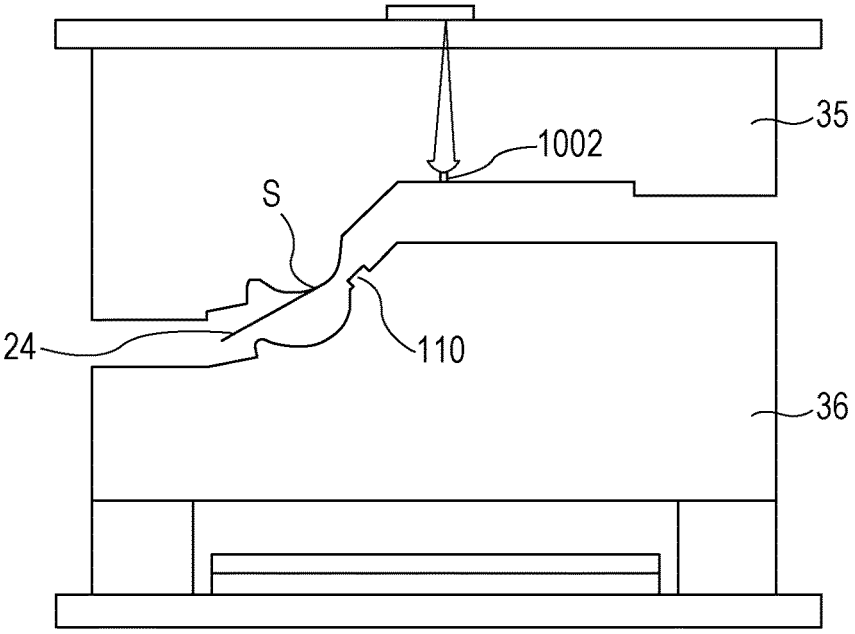
FIGS. 11A and 11B are cross-sectional views of an entire molding for molding the first frame member according to the embodiment.
Figure 11B:
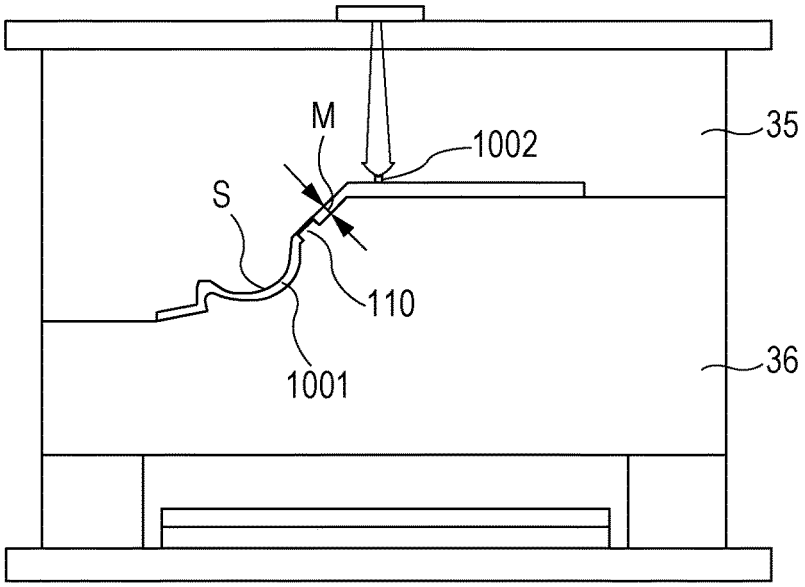

FIGS. 11A and 11B illustrate an example of a cross-sectional view of a molding for molding the first frame member (lid member) 122 as a whole. FIG. 11A is a drawing illustrating a state in which the molding is opened, and FIG. 11B is a drawing illustrating a state in which the molding is closed.

Reference numeral 35 denotes a first molding, reference numeral 36 denotes a second molding, and reference numeral 1002 denotes a gate. The first molding 35 and the second molding 36 have a shape which forms a surface shape of the first frame member (lid member) 122 when being transferred. The conductive sheet 24 is inserted into the molding in advance when the molding is in an opened state. The conductive sheet 24 may be fixed to the first molding 35 by forming a fine air hole at a portion S and coupling the fine air hole to a suction unit, which is not illustrated. Here, the conductive sheet 24 is fixed to the first molding 35 for shortening a molding cycle by enabling the conductive sheet 24 to be set to the first molding 35 after infusion of the resin has been completed and while the second molding 36 is opened. Therefore, it is not necessarily required to fix the conductive sheet 24 to the first molding 35, and may be fixed to the second molding 36. A known method may also be used instead of the methods described above.

Subsequently, the first molding 35 and the second molding 36 are mated (the moldings is closed). Fused resin is poured into a cavity 1001 defined by mating the moldings is filled with the fused resin from a gate 1002 to mold the first frame member (lid member) 122. When the first molding 35 and the second molding 36 are mated, the first molding 35 and the second molding 36 oppose each other at a distance M. Accordingly, the first frame member (lid member) 122 having a thickness M can be molded.

In the embodiment disclosed here, the second molding 36 includes a shape 110 for forming a portion which changes the interval of the distance M (the portion where the thickness is varied (thickness varied portion) formed in the adjacent portion to a portion in which the conductive sheet 24 is inserted, which corresponds to a part between the portion and the gate 1002.

Subsequently, an effect achieved by providing the shape for differentiating the distance of the cavity (thickness) (the shape for differentiating the thickness) will be described.

When the conductive sheet without having the shape for differentiating the thickness is integrally molded, the difference in resistance value within the conductive sheet is significant, whereby sensed values of the amount of the residual toner may vary accordingly. As a result of research, the following causes are found.

Figure 12:
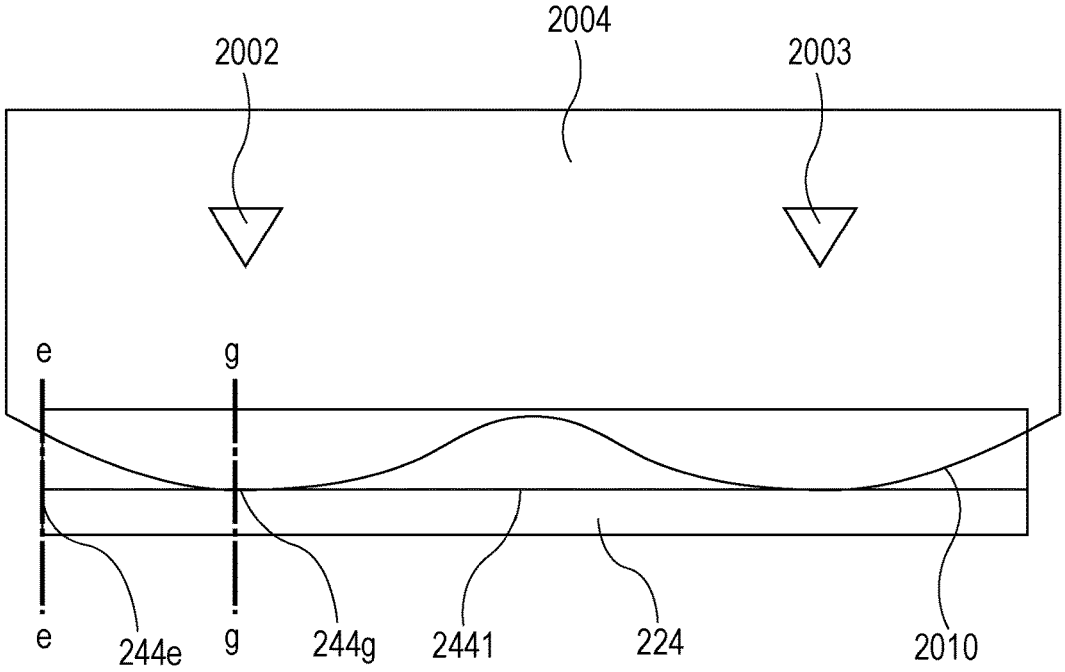
FIG. 12 is a conceptual drawing illustrating a flow of a resin in the interior of the molding in a state in which a portion having a shape for differentiating a distance of a cavity (thickness) is not formed.

FIG. 12 is a schematic drawing illustrating a flow of a resin in the interior of the molding in a state in which a shape for differentiating the thickness is not formed, and illustrates a state in which the cavity of the molding is filled with resin to a middle portion. Reference numeral 2010 denotes a distal end (flow front) of the resin. Reference numerals 2002 and 2003 denote gates, reference numeral 2004 denotes a resin, and reference numeral 224 denotes a conductive sheet. Reference numeral 2441 denotes a portion having a shape for transferring the bent portion 44 of the first frame member (lid member) 122 of the first molding. Here, a case where the resin is poured from the gates 2002 and 2003 at two positions will be described.

Figure 13A:
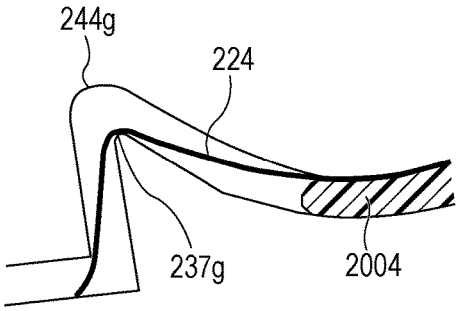
FIGS. 13A to 13D are partial cross-sectional views of FIG. 12.
Figure 13C:
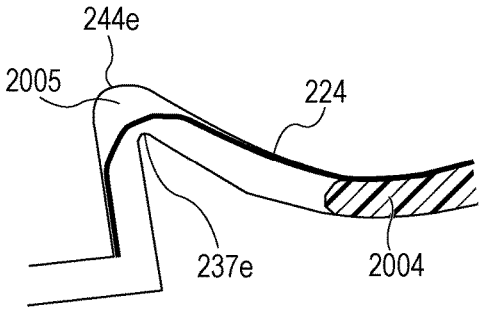
Figure 13B:
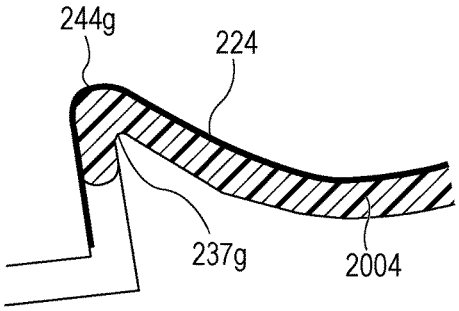

Reference numeral 244*g* denotes a portion having a shape for transferring the bent portion 44 of the first frame member (lid member) 122 in the first molding at a shortest distance from the gate 2002, which is at the closest position from a sheet end. Reference numeral 237*g* denotes a portion having a shape for transferring the bent portion 44 of the first frame member (lid member) 122 in the second molding. FIGS. 13A and 13B are cross-sectional view taken along the line g-g including the portions 244*g* and 237*g*.

Figure 13D:
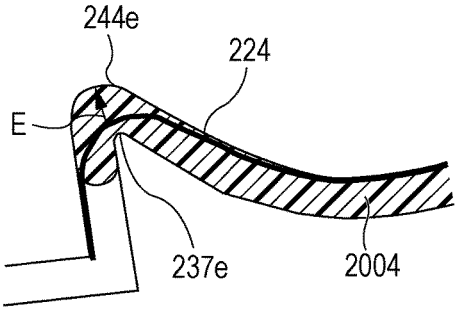

Reference numeral 244*e* denotes a portion having a shape for transferring the bent portion 44 of the first frame member (lid member) 122 in the first molding at the end of the conductive sheet, and reference numeral 237*e* denotes a portion having a shape for transferring the bent portion 44 of the first frame member (lid member) 122 in the second molding. FIGS. 13C and 13D are cross-sectional views taken along the line e-e including the end 244*e* and the portion 237*e*.

In a case where the thickness from the gate 2002 to a portion having a shape for transferring a bent portion is uniform, the fused resin flows concentrically. Subsequently, the resin first reaches the portions 244*g* and 237*g* having a shape for transferring the bent portion closest to the gate 2002. At this time, a conductive sheet 224 is located on the second molding side 237*g* (FIG. 13A). Subsequently, the conductive sheet 224 is lifted upward by the resin 2004 filling the cavity, and is pressed against the first molding side 244*g* (FIG. 13B). Thereafter, a cavity is filled with resin from the portion 244*g* to the end 244*e* in sequence. In the conductive sheet end 244*e* apart from the gate 2002, the resin reaches thereto in a state in which the sheet is almost fixed (FIG. 13C). Therefore, when a portion 2005, which is not filled with resin, on the first molding side with respect to the conductive sheet is filled with resin, the conductive sheet 224 is expanded locally in the direction indicated by an arrow E, and hence the conductive sheet is thinned. It took about 0.6 seconds from a moment when the resin has reached the portion 244*g* until a moment when the resin has reached the end 244*e*.

Figure 14:
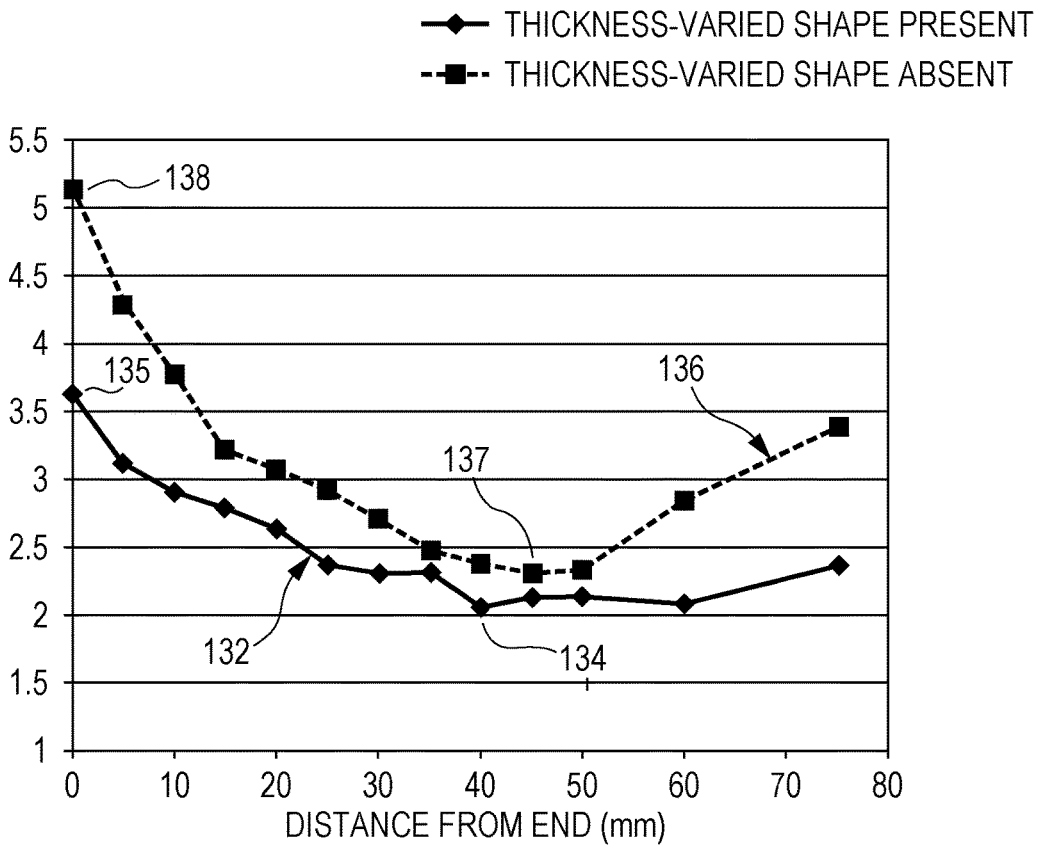
FIG. 14 is a drawing illustrating a surface resistance value of the conductive sheet.

The surface resistance value of the conductive sheet 224 at a bent portion 244 of the first frame member (lid member) taken out from the molding was measured. The result is shown by a dot line 136 in FIG. 14. It will be understood that a resistance value 137 at the bent portion (portion molded by 244*g*) closest to the gate 2002 was the lowest, and the value increases as it goes away from the gate 2002, and a ratio of a surface resistance value 138 at an end (portion molded by 244*e*) of the bent portion is the highest. The surface resistance value 138 at the end (portion molded by 244*e*) of the bent portion was approximately 2.2 times the surface resistance value 137 at the bent portion (portion molded by 244*e*) closest to the gate 2002. It seems that the difference in time of reaching the portion having a shape for transferring a bent portion causes the fused resin to be solidified and the conductive sheet to be fixed and, in this state, the bent portion was filled with resin, whereby the conductive sheet was expanded. Accordingly, differences occurred in thickness of the conductive sheet, which results in variations in resistance value.

Therefore, in the embodiment, a shape for varying (differentiating) the thickness is provided between the gate and the portion having a shape for transferring a bent portion so as to reduce the difference in times of resin reaching the portion having a shape for transferring a bent portion.

The shape for varying (differentiating) the thickness for forming the thickness varied portion will be described in detail below.

Figure 15:
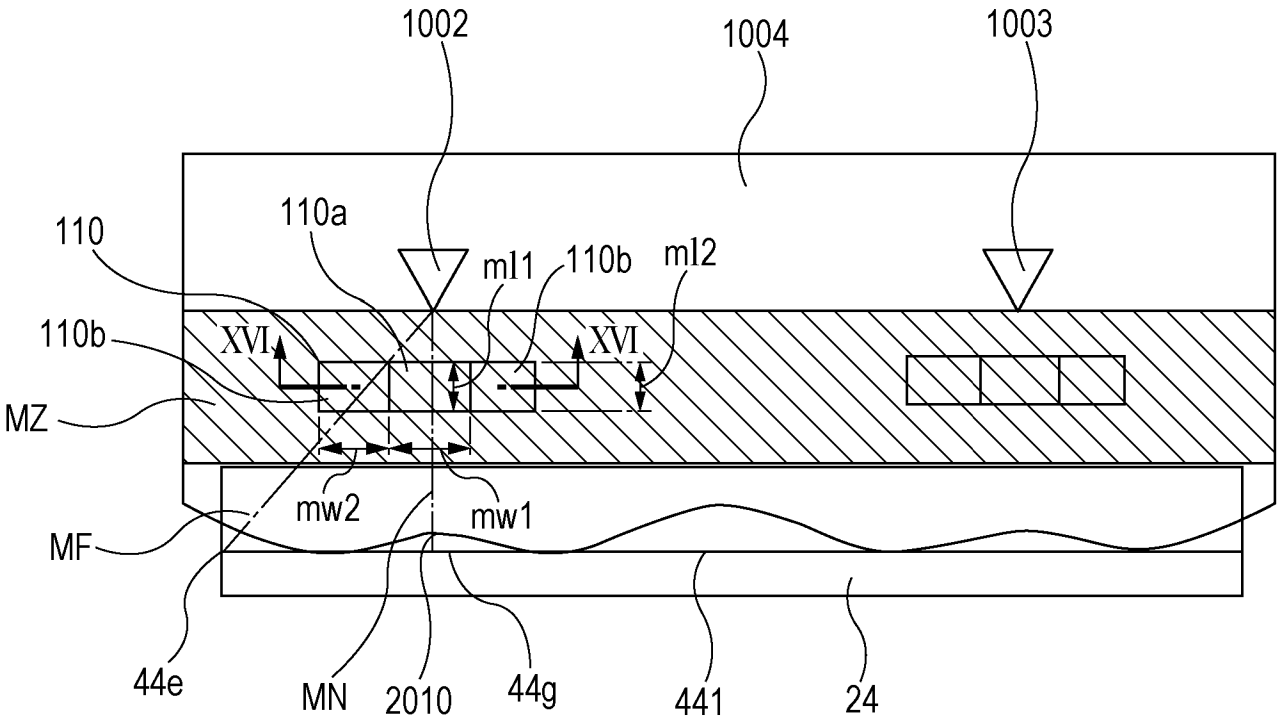
FIG. 15 is a conceptual drawing illustrating a flow of a resin in the interior of the molding in which the portion having a shape for differentiating a distance of the cavity (thickness) is provided.

FIG. 15 is a schematic drawing illustrating a flow of a resin in the interior of the molding having the shape 110 for differentiating the thickness and illustrates a state in which the cavity of the molding is filled with resin to a middle portion. Reference numeral 2010 denotes a distal end of the resin. Reference numerals 1002 and 1003 denote gates, reference numeral 1004 denotes a resin, and reference numeral 24 denotes a conductive sheet. Reference numeral 441 denotes a portion having a shape for transferring the bent portion 44 of the first frame member (lid member) 122 of the first molding. In this embodiment, a case where the cavity is filled with resin from the gates 1002 and 1003 at two positions will be described. However, this disclosure is not limited thereto, and the cavity may be filled with resin from only one gate or three or more gates.

Reference numeral 110 denotes a shape for differentiating the thickness formed in the molding, which is provided adjacent to the portion where the conductive sheet 24 is integrally adhered by the resin. The term "adjacent" means an area MW from an end of the portion where the conductive sheet is adhered to the gate.

In the embodiment disclosed here, an example in which a shape 110*a* for differentiating the thickness by a projecting shape having a projecting shape is formed in the second molding will be described. The shape 110*a* is formed on a line MN connecting a portion 44*g* having a shape for transferring the bent portion 44 of the first frame member (lid member) 122 in the second molding at the shortest distance from the gate 1002, which is located at the closest position from the sheet end, and the gate 1002. A projecting amount of the shape for differentiating the thickness by the projecting shape is preferably set to fall within a range from 0.2 mm to 0.5 mm. A width mw1 of the shape for differentiating the thickness by the projecting shape is preferably set to 20 mm or more.

In addition, a shape 110*b* for differentiating the thickness by a depressed shape, which is formed by depressing the second molding, may be formed at the end of the conductive sheet and the gate 1002 on a line MF connecting a portion 44*e* having a shape for transferring the bent portion 44 of the first frame member (lid member) 122 in the second molding. A width mw2 of a shape for differentiating the thickness by the depressed shape is preferably set to 30 mm or more.

The flow of the resin is differentiated by the shape for differentiating the thickness. Specifically by forming the shape for differentiating the thickness by the projecting shape in the second molding, the flow of the resin may be restrained. Specifically by forming the shape for differentiating the thickness by the depressed shape in the second molding, the flow of the resin may be accelerated. The shape for differentiating the thickness may be formed in the first molding. By forming the shape for differentiating the thickness by the projecting shape in the first molding, the flow of the resin may be restrained. By forming the shape for differentiating the thickness by the depressed shape in the first molding, the flow of the resin may be accelerated.

By forming the shape 110 for differentiating the thickness in the molding as described above in the mold, the difference at a distal end 2010 of the resin toward a portion 441 having a shape for transferring the bent portion is reduced in comparison with FIG. 12. The time required from a moment when the resin has reaches 44*g* until a moment when the resin reaches 44*e* may be controlled to be not more than approximately 0.4 seconds.

The first frame member (lid member) was molded with the molding in which the shape 110 for differentiating the thickness illustrated in FIG. 15 was formed, and the surface resistance value of the conductive sheet 24 at the bent portion 44 was measured. The result is shown by a solid line 132 in FIG. 14. A resistance value 134 at the bent portion (portion molded by 44*g*) closest to the gate 1002 was the lowest, and the value increases as it goes away from the gate 1002, and a surface resistance value ratio 135 at an end (portion molded by 244*e*) of the bent portion was the highest. It is understood that the difference in resistance value is significantly reduced by forming the shape 110 for differentiating the thickness. By reducing the difference in time from a moment when the resin reaches 44*g* until the resin reaches 44*e* as much as possible, the local extension of the sheet by being fixed can be successfully restrained, so that variations in thickness of the conductive sheet may be restrained and the difference in surface resistance value may be reduced. Accordingly, reliability of sensing of the amount of remaining toner is further improved. The different between the time required from a moment when the resin has reaches 44*g* and a moment when the resin reaches 44*e* is preferably controlled to be not more than 0.4 seconds.

Subsequently, a method of molding the contact portion 24*b* of the conductive sheet 24 will be described. A holding pin is arranged in the first molding in order to press the contact portion 24*b* of the conductive sheet reliably against the second molding. The holding pin is configured to be fixed at the contact portion 24*b* to the second molding by a spring force in a step in which the molding is closed. With a configuration in which a cavity is filled with resin so as to cause the holding pin to be retracted by a resin pressure in the step in which the molding is closed, the contact portion 24*b* is exposed to the surface b on the back when molding.

Although the first frame member (lid member) is molded and manufactured by the method of manufacturing the molded article of the embodiment disclosed here, the method is not limited thereto.

EXAMPLE

Subsequently, Examples will be described. A simulation was performed by varying the shape of the shape 110 for differentiating the thickness illustrated in FIG. 15. FIGS. 16A to 16D illustrate cross-sectional views taken along the line XVI-XVI in FIG. 15 and top views of the shapes for differentiating the thickness.

Example 1 to Example 5, Comparative Example

Figure 16A:
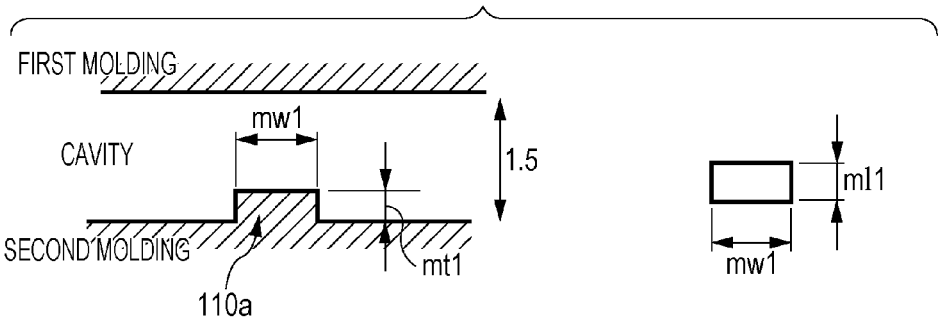
FIGS. 16A to 16D are conceptual drawings of the portions having a shape for differentiating the distance of the cavity (thickness) according to the embodiment.

A simulation using a molding shape having the shape 110*a* for differentiating the thickness by the projecting shape illustrated in FIG. 16A was performed. In this example, the shape 110*b* for differentiating the thickness is not provided. Specifically, a standard thickness (the thickness of the molded article of a portion where the thickness is not varied) was set to 1.5 mm. The shape of the shape 110*a* for differentiating the thickness by the projecting shape was set to a width mw1 of 30 mm, a length ml1 of 12 mm, and a projecting amount (amount of thickness variation) mt1 was varied to 0.1 mm to 0.5 mm. The term "standard thickness" in this specification indicates the thickness of a portion of the molded article where the thickness is not varied, or a thickness which takes up a half or more of the thickness of the molded article. Subsequently, the time from a moment when the resin started to fill a cavity from the gate to a moment when the distal end of the resin (flow front) reaches the portion 44*g* having a shape for transferring the bent portion closest from the gate was obtained by the simulation. Also, the time from a moment when the resin started to fill a cavity from the gate to a moment when the resin reaches the portion 44*e* having a shape for transferring the bent portion at the sheet end was obtained by the simulation. Subsequently, the different in reaching time was obtained. The difference in reaching time was obtained in the same manner with Comparative Example in which the shape for differentiating the thickness was not provided. The result is shown in Table 1

TABLE 1

| | mt1(mm) | 44g reaching time (s) | 44e reaching time (s) | difference in reaching time (s) |
|---|---|---|---|---|
| Example 1 | 0.1 | 1.196 | 1.679 | 0.483 |
| Example 2 | 0.2 | 1.26 | 1.659 | 0.399 |
| Example 3 | 0.3 | 1.323 | 1.659 | 0.336 |
| Example 4 | 0.4 | 1.365 | 1.66 | 0.295 |
| Example 5 | 0.5 | 1.367 | 1.661 | 0.294 |
| Comparative Example | 0 | 1.154 | 1.7 | 0.546 |

From Table 1, in comparison with a case where the shape for differentiating the thickness is not provided, it was found that the difference in reaching time to 44*g* and the reaching time to 44*e* was reduced when the shape for differentiating the thickness is provided. Accordingly, the change in thickness of the sheet by solidification of the resin is restrained. Also, in order to achieve a better effect, it was found that the projecting amount (amount of thickness variation) mt1 of the shape for differentiating the thickness is preferably set to fall within a range from 0.2 mm to 0.5 mm.

Example 6 to Example 10

A simulation using a molding shape having the shape 110*a* for differentiating the thickness by the projecting shape illustrated in FIG. 16A was performed. In this example, the shape 110*b* for differentiating the thickness is not provided. Specifically, a standard thickness (the thickness of the molded article of a portion where the thickness is not varied) was set to 1.5 mm. The shape of the shape 110*a* for differentiating the thickness was varied to have a length ml1 of 12 mm, a projecting amount (amount of thickness variation) mt1 of 0.3 mm, and a width mw1 of 10 mm to 50 mm. Subsequently, the time from a moment when the resin started to fill a cavity from the gate to a moment when the distal end of the resin (flow front) reaches the portion 44*g* having a shape for transferring the bent portion closest from the gate was obtained by the simulation. Also, the time from a moment when the resin started to fill a cavity from the gate to a moment when the resin reaches the portion 44*e* having a shape for transferring the bent portion at the sheet end was obtained by the simulation. Subsequently, the difference in reaching time was obtained. The result is shown in Table 2

TABLE 2

| | mt1(mm) | 44g reaching time (s) | 44e reaching time (s) | difference in reaching time (s) |
|---|---|---|---|---|
| Example 6 | 10 | 1.183 | 1.7 | 0.517 |
| Example 7 | 20 | 1.28 | 1.679 | 0.399 |
| Example 8 | 30 | 1.323 | 1.659 | 0.336 |
| Example 9 | 40 | 1.386 | 1.658 | 0.272 |
| Example 10 | 50 | 1.364 | 1.658 | 0.294 |

From Table 2, in comparison with a case where the shape for differentiating the thickness was not provided (see Comparative Example in Table 1), it was found that the difference in reaching time to 44*g* and the reaching time to 44*e* was reduced when the shape for differentiating the thickness was provided. Accordingly, the change in thickness of the sheet by solidification of the resin is restrained. Also, in order to achieve a better effect, it was found that the width mw1 of the shape for differentiating the thickness was preferably set to be not smaller than 20 mm.

Example 11 to Example 13

A simulation using a molding shape having the shape 110*a* for differentiating the thickness by the projecting shape illustrated in FIG. 16A was performed. In this example, the shape 110*b* for differentiating the thickness is not provided. Specifically, a standard thickness (the thickness of the molded article of a portion where the thickness is not varied) was set to 1.5 mm. The shape of the shape 110*a* for differentiating the thickness was varied to have a projecting amount (amount of thickness variation) mt1 of 0.3 mm, a width mw1 of 30 mm, and a length ml1 of 6 mm to 15 mm. Subsequently, the time from a moment when the resin started to fill a cavity from the gate to a moment when the distal end of the resin (flow front) reaches the portion 44*g* having a shape for transferring the bent portion closest from the gate was obtained by the simulation. Also, the time from a moment when the resin started to fill a cavity from the gate to a moment when the resin reaches the portion 44*e* having a shape for transferring the bent portion at the sheet end was obtained by the simulation. Subsequently, the difference in reaching time was obtained. The result is shown in Table 3

TABLE 3

| | mt1(mm) | 44g reaching time (s) | 44e reaching time (s) | difference in reaching time (s) |
|---|---|---|---|---|
| Example 11 | 6 | 1.218 | 1.68 | 0.462 |
| Example 12 | 12 | 1.323 | 1.659 | 0.336 |
| Example 13 | 15 | 1.346 | 1.661 | 0.315 |

From Table 3, in comparison with a case where the shape for differentiating the thickness was not provided (see Comparative Example in Table 1), it was found that the difference in reaching time to 44*g* and the reaching time to 44*e* was reduced. Accordingly, the change in thickness of the sheet by solidification of the resin is restrained.

Example 14 to Example 16

Figure 16B:
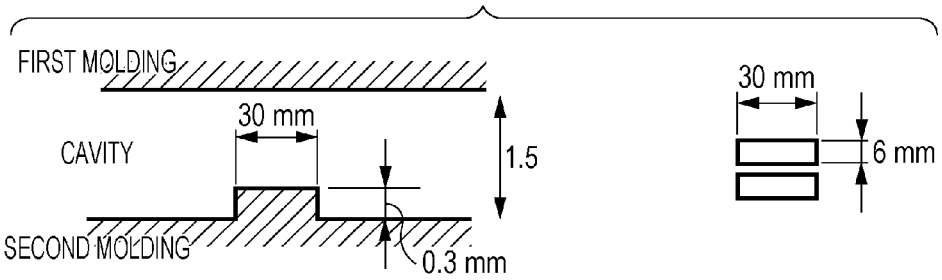
Figure 16C:
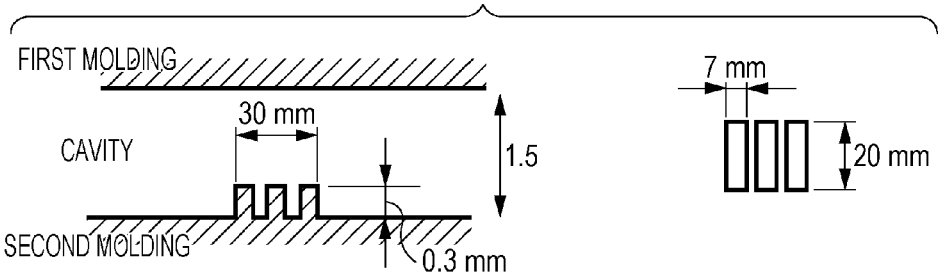
Figure 16D:
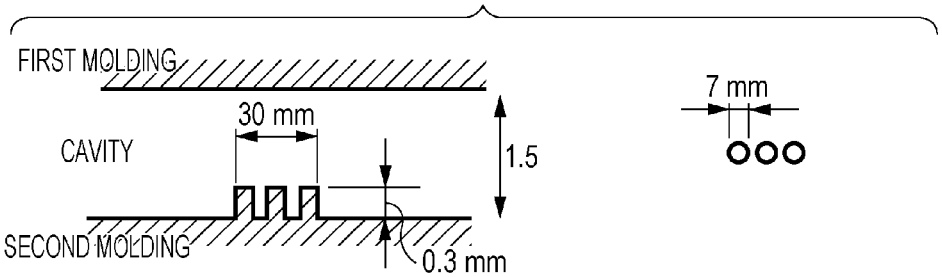

A simulation using a molding shape having the shape 110*a* for differentiating the thickness by the projecting shape illustrated in FIG. 16B to FIG. 16D was performed. In this example, the shape 110*b* for differentiating the thickness is not provided.

The time from a moment when the resin started to fill a cavity from the gate to a moment when the distal end of the resin (flow front) reaches the portion 44*g* having a shape for transferring the bent portion closest from the gate was obtained by the simulation. Also, the time from a moment when the resin started to fill a cavity from the gate to a moment when the resin reaches the portion 44*e* having a shape for transferring the bent portion at the sheet end was obtained by the simulation. Subsequently, the difference in reaching time was obtained. The result is shown in Table 4

TABLE 4

| | Mt1(mm) *Number of Pieces | 44g reaching time (s) | 44e reaching time (s) | difference in reaching time (s) |
|---|---|---|---|---|
| Example 14 | □6*30*2 | 1.324 | 1.66 | 0.336 |
| Example 15 | □20*7*3 | 1.238 | 1.679 | 0.441 |
| Example 16 | ○7*3 | 1.239 | 1.68 | 0.441 |

From Table 4, in comparison with a case where the shape for differentiating the thickness was not provided (see Comparative Example in Table 1), it was found that the difference in reaching time to 44*g* and the reaching time to 44*e* was reduced. Accordingly, the change in thickness of the sheet by solidification of the resin is restrained.

Example 17 to Example 20

Figure 17A:
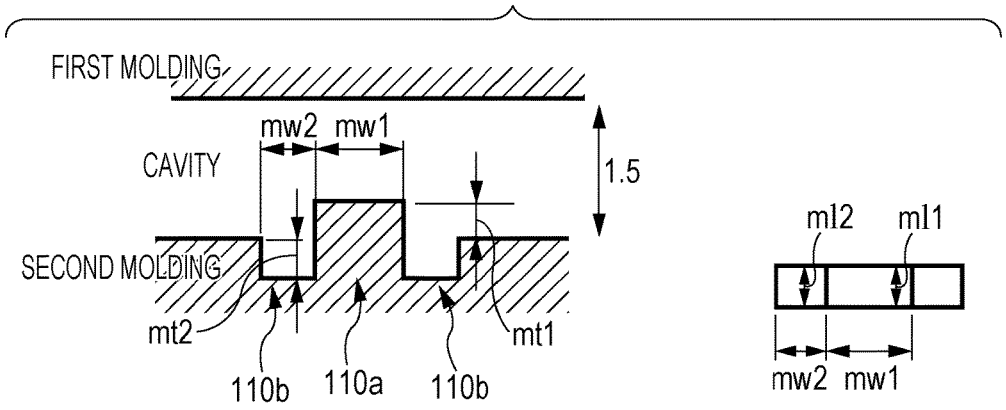
FIGS. 17A and 17B are conceptual drawings of the portions having a shape for differentiating the distance of the cavity (thickness) according to the embodiment.

A simulation with a molding shape having a shape for differentiating the thickness provided with the shape 110*b* for differentiating the thickness by the depressed shape adjacently to the shape 110*a* for differentiating the thickness by the projecting shape illustrated in FIG. 17A was performed. Specifically, a standard thickness (the thickness of the molded article of a portion where the thickness is not varied) was set to 1.5 mm. The shape of the shape 110*a* for differentiating the thickness was varied to have a projecting amount (amount of thickness variation) mt1 of 0.3 mm, a width mw1 of 30 mm, and a length ml1 of 12 mm. The shape of the shape 110*b* for differentiating the thickness provided adjacent to the shape 110*a* for differentiating the thickness by the projecting shape was varied to have a depressed amount (amount of thickness variation) mt2 of 0.3 mm, and a length ml2 of 12 mm, and a width mw2 of 10 mm to 40 mm. Subsequently, the time from a moment when the resin started to fill a cavity from the gate to a moment when the distal end of the resin (flow front) reaches the portion 44*g* having a shape for transferring the bent portion closest from the gate was obtained by the simulation. Also, the time from a moment when the resin started to fill a cavity from the gate to a moment when the resin reaches the portion 44*e* having a shape for transferring the bent portion at the sheet end was obtained by the simulation. Subsequently, the difference in reaching time was obtained.

TABLE 5

| | mw2 | 44g reaching time (s) | 44e reaching time (s) | difference in reaching time (s) |
|---|---|---|---|---|
| Example 17 | 10 | 1.24 | 1.661 | 0.421 |
| Example 18 | 20 | 1.261 | 1.619 | 0.358 |
| Example 19 | 30 | 1.284 | 1.578 | 0.294 |
| Example 20 | 40 | 1.284 | 1.558 | 0.274 |

From Table 5, in comparison with a case where the shape for differentiating the thickness was not provided (see Comparative Example in Table 1), it was found that the difference in reaching time to 44*g* and the reaching time to 44*e* was reduced. In Embodiment 19 and Embodiment 20, it was found that the difference in reaching time is reduced in comparison with a case where the shape 110*b* for differentiating the thickness is not provided (see Example 12). From these reasons, a width of a shape for differentiating the thickness by the depressed shape is preferably 30 mm or more.

Example 21 to Example 23

A simulation with a molding shape having a shape for differentiating the thickness provided with the shape 110*b* for differentiating the thickness by the depressed shape adjacently to the shape 110*a* for differentiating the thickness by the projecting shape illustrated in FIG. 17A was performed. Specifically, a standard thickness (the thickness of the molded article of a portion where the thickness was not varied) was set to 1.5 mm. The shape of the shape 110*a* for differentiating the thickness was varied to have a projecting amount (amount of thickness variation) mt1 of 0.3 mm, a width mw1 of 30 mm, and a length ml1 of 12 mm. The shape of the shape 110*b* for differentiating the thickness provided adjacently to the shape 110*a* for differentiating the thickness by the projecting shape was varied to have a length ml2 of 12 mm, a width mw2 of 20 mm, and a depressed amount (amount of thickness variation) mt2 to be 0.2 mm to 0.5 mm. Subsequently, the time from a moment when the resin started to fill a cavity from the gate to a moment when the distal end of the resin (flow front) reaches the portion 44*g* having a shape for transferring the bent portion closest from the gate was obtained by the simulation. Also, the time from a moment when the resin started to fill a cavity from the gate to a moment when the resin reaches the portion 44*e* having a shape for transferring the bent portion at the sheet end was obtained by the simulation. Subsequently, the difference in reaching time was obtained. The result is shown in Table 6

TABLE 6

| | mt2 | 44g reaching time (s) | 44e reaching time (s) | difference in reaching time (s) |
|---|---|---|---|---|
| Example 21 | 0.2 | 1.282 | 1.64 | 0.358 |
| Example 22 | 0.3 | 1.261 | 1.619 | 0.358 |
| Example 23 | 0.5 | 1.242 | 1.599 | 0.357 |

From Table 6, in comparison with a case where the shape for differentiating the thickness was not provided (see Comparative Example in Table 1), it was found that the difference in reaching time to 44*g* and the reaching time to 44*e* was reduced when the shape for differentiating the thickness is provided. Variations on the basis of the projecting amount were not much observed.

Example 24

A simulation with a molding shape having a shape for differentiating the thickness provided with the shape 110*b* for differentiating the thickness by the depressed shape adjacently to the shape 110*a* for differentiating the thickness by the projecting shape illustrated in FIG. 17A was performed. Specifically, a standard thickness (the thickness of the molded article of a portion where the thickness is not varied) was set to 1.5 mm. The shape of the shape 110*a* for differentiating the thickness was varied to have a projecting amount (amount of thickness variation) mt1 of 0.3 mm, a width mw1 of 30 mm, and a length ml1 of 12 mm. The shape of the shape 110*b* for differentiating the thickness provided adjacently to the shape 110*a* for differentiating the thickness by the projecting shape was varied to have a width mw2 of 20 mm, and a depressed amount (amount of thickness variation) mt2 to be 0.3 mm, and a length ml2 of 20 mm. Subsequently, the time from a moment when the resin started to fill a cavity from the gate to a moment when the distal end of the resin (flow front) reaches the portion 44*g* having a shape for transferring the bent portion closest from the gate was obtained by the simulation. Also, the time from a moment when the resin started to fill a cavity from the gate to a moment when the resin reaches the portion 44*e* having a shape for transferring the bent portion at the sheet end was obtained by the simulation. Subsequently, the difference in reaching time was obtained. The result is shown in Table 7

TABLE 7

| | ml2 | 44g reaching time (s) | 44e reaching time (s) | difference in reaching time (s) |
|---|---|---|---|---|
| Example 24 | 20 | 1.22 | 1.578 | 0.358 |

From Table 7, in comparison with a case where the shape for differentiating the thickness was not provided (see Comparative Example in Table 1), it was found that the difference in reaching time to 44*g* and the reaching time to 44*e* was reduced when the shape for differentiating the thickness was provided. Variations on the basis of the length were not much observed.

Example 25

Figure 17B:
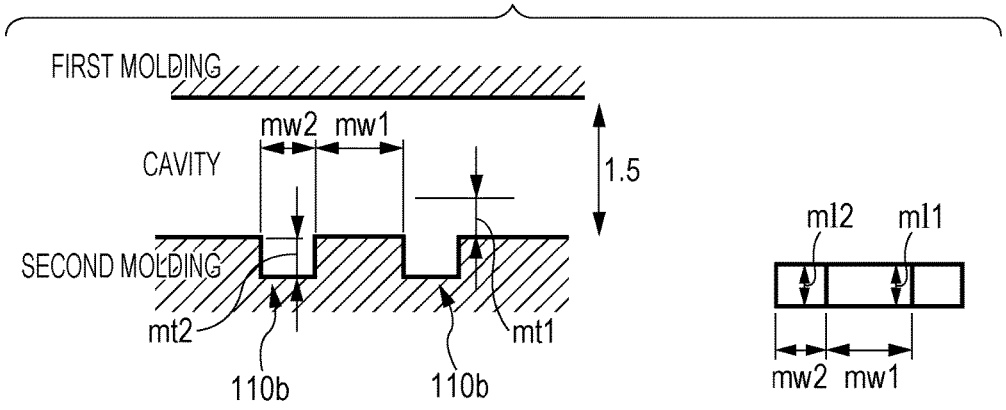

A simulation with a molding shape having a shape for differentiating the thickness only by the shape 110*b* for differentiating the thickness by the depressed shape was performed without providing the shape 110*a* for differentiating the thickness illustrated in FIG. 17B. Specifically, a standard thickness (the thickness of the molded article of a portion where the thickness is not varied) was set to 1.5 mm. The shapes 110*b* for differentiating the thickness by the depressed shape are provided at two positions 30 mm away from each other. The shape 110*b* for differentiating the thickness by the depressed shape was set to have a width mw2 of 20 mm, and a depressed amount (amount of thickness variation) mt2 of 0.3 mm, and a length ml2 of 12 mm. Subsequently, the time from a moment when the resin started to fill a cavity from the gate to a moment when the distal end of the resin (flow front) reaches the portion 44*g* having a shape for transferring the bent portion closest from the gate was obtained by the simulation. Also, the time from a moment when the resin started to fill a cavity from the gate to a moment when the resin reaches the portion 44*e* having a shape for transferring the bent portion at the sheet end was obtained by the simulation. Subsequently, the difference in reaching time was obtained. The result is shown in Table 8

TABLE 8

| | mt2 | 44g reaching time (s) | 44e reaching time (s) | difference in reaching time (s) |
|---|---|---|---|---|
| Example 25 | 0.3 | 1.155 | 1.639 | 0.484 |

From Table 8, in comparison with a case where the shape for differentiating the thickness was not provided (see Comparative Example in Table 1), it was found that the difference in reaching time to 44*g* and the reaching time to 44*e* was reduced when the shape for differentiating the thickness was provided. Accordingly, the change in thickness of the sheet by solidification of the resin is restrained.

Advantageous Effects of the Invention

According to this disclosure, the conductive sheet may be molded integrally with the first frame member (lid member), and hence space saving of the image forming apparatus and improvement of reliability of sensing of the amount of remaining toner are realized in a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-146303, filed Jul. 12, 2013 which is hereby incorporated by reference herein in its entirety.

What is claimed is:

1. A developing apparatus comprising:

a first frame member molded by pouring resin from a gate, with a conductive sheet integrally adhered by the resin; and a second frame member configured to define a toner storage portion by being coupled with the first frame member, wherein the first frame member includes a bent portion to which the conductive sheet is adhered, and a thickness varied portion and wherein the thickness varied portion is formed adjacent to the conductive sheet and between the conductive sheet and the gate.

2. The developing apparatus according to claim 1 wherein an amount of variation in thickness of the thickness varied portion having a reduced thickness falls within a range from 0.2 mm to 0.5 mm with respect to a standard thickness.

3. The developing apparatus according to claim 1, wherein the thickness varied portion having the reduced thickness is on a line connecting the gate trace and the bent portion closest to the gate trace.

4. The developing apparatus according to claim 1 wherein a width of the thickness varied portion having a reduced thickness is at least 20 mm.

5. The developing apparatus according to claim 1, wherein the thickness varied portion includes a portion having a thickness larger than a standard thickness adjacently to the depression having a thickness smaller than the standard thickness.

6. The developing apparatus according to claim 5, wherein the thickness varied portion having an increased thickness is on a line connecting the bent portion at an end of the conductive sheet and the gate trace closest to the bent portion at the end of the conductive sheet.

7. The developing apparatus according to claim 6 wherein a width of the thickness varied portion having the increased thickness is at least 30 mm.

8. A process cartridge comprising:

a first frame member molded by pouring resin from a gate, with a conductive sheet integrally adhered by the resin; and a second frame member configured to define a toner storage portion by being coupled with the first frame member, wherein the first frame member includes a bent portion to which the conductive sheet is adhered and a thickness varied portion, and wherein the thickness varied portion is formed adjacent to the conductive sheet and between the conductive sheet and the gate.

9. The process cartridge according to claim 8, wherein the thickness varied portion having a reduced thickness is on a line connecting the gate trace and the bent portion closest to the gate trace.

10. The process cartridge according to claim 8, wherein the thickness varied portion is a portion adjacent to the depression having the reduced thickness and having an increased thickness.

11. The process cartridge according to claim 10, wherein the thickness varied portion having the increased thickness is on a line connecting the bent portion at an end of the conductive sheet and the gate trace closest to the bent portion at the end of the conductive sheet.

* * * * *